US008152078B2

(12) United States Patent
Jianglin et al.

(10) Patent No.: US 8,152,078 B2
(45) Date of Patent: Apr. 10, 2012

(54) FAUCET SPRAY HEAD

(75) Inventors: Yan Jianglin, Fujian (CN); Chen Ximin, Fujian (CN)

(73) Assignee: Masco Corporation of Indiana, Indianapolis, IN (US)

( * ) Notice: Subject to any disclaimer, the term of this patent is extended or adjusted under 35 U.S.C. 154(b) by 767 days.

(21) Appl. No.: 11/923,205

(22) Filed: Oct. 24, 2007

(65) Prior Publication Data

US 2008/0105764 A1 May 8, 2008

(30) Foreign Application Priority Data

Oct. 25, 2006 (CN) ..... 2006 2 0066767 U
Oct. 25, 2006 (CN) ..... 2006 2 0066768 U
Oct. 25, 2006 (CN) ..... 2006 2 0066769 U

(51) Int. Cl.
*B05B 7/02* (2006.01)

(52) U.S. Cl. ..... 239/528; 239/526; 239/586; 239/391; 239/444; 137/862

(58) Field of Classification Search ..... 137/862, 137/871, 867, 872; 239/390, 391, 397, 436, 239/442, 444–449, 525–528, 853, 586
See application file for complete search history.

(56) References Cited

U.S. PATENT DOCUMENTS

| | | | |
|---|---|---|---|
| 603,144 | A | 4/1898 | Kellerman et al. |
| 1,123,189 | A | 12/1914 | Moore et al. |
| 1,647,983 | A | 11/1927 | Bloch |
| 2,314,071 | A | 3/1943 | Bucknell et al. |
| 2,331,741 | A | 10/1943 | Smith |
| 2,416,747 | A | 3/1947 | Geimer |
| 2,566,878 | A | 9/1951 | Fahrenkrog et al. |
| 2,567,176 | A | 9/1951 | Ballard |
| 2,584,943 | A | 2/1952 | Thomas |
| 2,956,579 | A | 10/1960 | Hannaford |
| 3,022,015 | A | 2/1962 | Burch |
| 3,144,878 | A | 8/1964 | Williams |
| 3,207,443 | A | 9/1965 | Gilmour |
| 3,341,132 | A | 9/1967 | Parkison |
| 3,524,591 | A | 8/1970 | Samuels et al. |
| 3,545,473 | A | 12/1970 | Moia |
| 3,588,040 | A | 6/1971 | Ward |
| 3,591,083 | A | 7/1971 | O'Rear |
| 3,656,503 | A | 4/1972 | Ward |
| 3,682,392 | A | 8/1972 | Kint |
| 3,698,644 | A | 10/1972 | Nystuen |
| 3,722,525 | A | 3/1973 | Epple |
| 3,722,798 | A | 3/1973 | Bletcher et al. |
| 3,768,735 | A | 10/1973 | Ward |

(Continued)

FOREIGN PATENT DOCUMENTS

| | | |
|---|---|---|
| DE | 3306947 | 8/1984 |

(Continued)

*Primary Examiner* — Jason Boeckmann
(74) *Attorney, Agent, or Firm* — Faegre Baker Daniels

(57) ABSTRACT

A faucet spray head or gun body arrangement, including a spray gun body, a spray gun press handle, a spray gun inner core tube and control means, the spray gun press handle being movably fixed on the spray gun body, the spray gun inner core tube being disposed in the spray gun body, and the control means engaging with the spray gun inner core tube and the spray gun press handle, wherein two outlet waterways are provided in the spray gun inner core tube, and the control means is provided with a movable central pin controlling and shifting the two outlet waterways of the spray gun inner core tube.

20 Claims, 12 Drawing Sheets

U.S. PATENT DOCUMENTS

| | | | |
|---|---|---|---|
| 3,786,995 | A | 1/1974 | Manoogian et al. |
| 3,851,825 | A | 12/1974 | Parkison et al. |
| 3,902,671 | A | 9/1975 | Symmons |
| 3,944,141 | A | 3/1976 | Siczek |
| 4,029,119 | A | 6/1977 | Klieves |
| 4,119,276 | A | 10/1978 | Nelson |
| 4,187,986 | A | 2/1980 | Petrovic |
| 4,221,337 | A | 9/1980 | Shames et al. |
| 4,224,962 | A | 9/1980 | Orszullok |
| 4,257,460 | A | 3/1981 | Paranay et al. |
| 4,396,156 | A | 8/1983 | Southworth et al. |
| 4,398,669 | A | 8/1983 | Fienhold |
| 4,461,052 | A | 7/1984 | Mostul |
| 4,524,911 | A | 6/1985 | Rozniecki |
| 4,534,512 | A | 8/1985 | Chow et al. |
| 4,541,568 | A | 9/1985 | Lichfield |
| 4,581,707 | A | 4/1986 | Millar |
| 4,582,253 | A | 4/1986 | Gerdes |
| 4,606,370 | A | 8/1986 | Geipel et al. |
| 4,618,100 | A | 10/1986 | White et al. |
| 4,619,403 | A | 10/1986 | Goldney et al. |
| 4,629,124 | A | 12/1986 | Gruber |
| 4,650,120 | A | 3/1987 | Kress |
| 4,666,085 | A | 5/1987 | Liaw |
| 4,696,322 | A | 9/1987 | Knapp et al. |
| 4,703,893 | A | 11/1987 | Gruber |
| 4,776,517 | A | 10/1988 | Heren |
| 4,785,998 | A | 11/1988 | Takagi |
| RE32,981 | E | 7/1989 | Marty |
| 4,909,443 | A | 3/1990 | Takagi |
| 4,927,115 | A | 5/1990 | Bahroos et al. |
| 4,934,402 | A | 6/1990 | Tarney et al. |
| 4,955,546 | A | 9/1990 | Liaw |
| 4,997,131 | A | 3/1991 | Heren |
| 5,014,919 | A | 5/1991 | Knapp |
| 5,052,587 | A | 10/1991 | Graves |
| 5,069,241 | A | 12/1991 | Hochstrasse |
| 5,093,943 | A | 3/1992 | Wei |
| 5,100,055 | A | 3/1992 | Rokitenetz et al. |
| 5,143,299 | A | 9/1992 | Simonetti et al. |
| 5,145,114 | A | 9/1992 | Monch |
| 5,158,234 | A | 10/1992 | Magnenat et al. |
| 5,160,092 | A | 11/1992 | Rose et al. |
| 5,172,866 | A | 12/1992 | Ward |
| 5,184,777 | A | 2/1993 | Magnenat et al. |
| 5,201,468 | A | 4/1993 | Freier et al. |
| 5,232,162 | A | 8/1993 | Chih |
| 5,255,848 | A | 10/1993 | Rhodehouse |
| 5,323,968 | A | 6/1994 | Kingston et al. |
| 5,333,792 | A | 8/1994 | Wang |
| 5,348,228 | A | 9/1994 | Wang |
| 5,348,231 | A | 9/1994 | Arnold et al. |
| 5,370,314 | A | 12/1994 | Gebauer et al. |
| 5,383,604 | A | 1/1995 | Boesch |
| 5,398,872 | A | 3/1995 | Joubran |
| 5,433,384 | A | 7/1995 | Chan et al. |
| 5,445,182 | A | 8/1995 | Sturman et al. |
| 5,467,927 | A | 11/1995 | Lee |
| 5,477,885 | A | 12/1995 | Knapp |
| 5,507,314 | A | 4/1996 | Knapp |
| 5,630,548 | A | 5/1997 | Chih |
| 5,634,220 | A | 6/1997 | Chiu |
| 5,647,537 | A | 7/1997 | Bergmann |
| 5,649,562 | A | 7/1997 | Sturman et al. |
| 5,662,273 | A | 9/1997 | Chih |
| 5,662,276 | A | 9/1997 | Ko |
| 5,669,558 | A | 9/1997 | Ichel |
| 5,707,011 | A | 1/1998 | Bosio |
| 5,722,597 | A | 3/1998 | Guo |
| 5,732,884 | A | 3/1998 | Jauner |
| 5,735,467 | A | 4/1998 | Lee |
| 5,743,286 | A | 4/1998 | Ko |
| 5,772,120 | A | 6/1998 | Huber |
| 5,794,854 | A | 8/1998 | Yie |
| 5,806,770 | A | 9/1998 | Wang |
| 5,806,771 | A | 9/1998 | Loschelder et al. |
| 5,813,435 | A | 9/1998 | Knapp |
| 5,823,229 | A | 10/1998 | Bertrand et al. |
| 5,829,681 | A | 11/1998 | Hamel et al. |
| 5,853,130 | A | 12/1998 | Ellsworth |
| 5,858,215 | A | 1/1999 | Burchard et al. |
| 5,873,531 | A | 2/1999 | Wang |
| 5,887,796 | A | 3/1999 | Dimmer |
| 5,906,319 | A | 5/1999 | Crowl |
| 5,918,816 | A | 7/1999 | Huber |
| 5,927,333 | A | 7/1999 | Grassberger |
| 5,937,905 | A * | 8/1999 | Santos ..... 137/871 |
| 5,944,141 | A | 8/1999 | Kochan et al. |
| 5,971,299 | A | 10/1999 | Loschelder et al. |
| 5,975,429 | A | 11/1999 | Jezek |
| 5,975,432 | A | 11/1999 | Han |
| 5,984,207 | A | 11/1999 | Wang |
| 6,000,626 | A | 12/1999 | Futo et al. |
| 6,000,637 | A | 12/1999 | Duncan |
| 6,007,003 | A | 12/1999 | Wang |
| 6,016,975 | A | 1/2000 | Amaduzzi |
| 6,045,062 | A | 4/2000 | Bosio |
| 6,048,181 | A | 4/2000 | Chang |
| 6,058,971 | A | 5/2000 | Palmer et al. |
| 6,059,200 | A | 5/2000 | Chou |
| 6,076,743 | A | 6/2000 | Fan |
| 6,085,790 | A | 7/2000 | Humpert et al. |
| 6,129,294 | A | 10/2000 | Hsin-Fa |
| 6,145,757 | A | 11/2000 | Knapp |
| 6,151,729 | A | 11/2000 | Yean |
| 6,158,152 | A | 12/2000 | Nathenson et al. |
| 6,164,566 | A | 12/2000 | Hui-Chen |
| 6,173,910 | B1 | 1/2001 | Yean |
| 6,173,911 | B1 | 1/2001 | Hui-Chen |
| 6,179,130 | B1 | 1/2001 | Nguyen et al. |
| 6,216,965 | B1 | 4/2001 | Chao |
| 6,220,297 | B1 | 4/2001 | Marty et al. |
| 6,230,989 | B1 | 5/2001 | Haverstraw et al. |
| 6,234,192 | B1 | 5/2001 | Esche et al. |
| 6,247,654 | B1 | 6/2001 | Kuo |
| D445,874 | S | 7/2001 | Czerwinski, Jr. et al. |
| 6,254,016 | B1 | 7/2001 | Chao |
| 6,260,772 | B1 | 7/2001 | Hennemann, Jr. et al. |
| 6,260,774 | B1 | 7/2001 | Erickson |
| 6,290,147 | B1 | 9/2001 | Bertrand |
| 6,296,011 | B1 | 10/2001 | Esche et al. |
| 6,302,339 | B1 | 10/2001 | Chou |
| 6,305,619 | B1 | 10/2001 | Thurn |
| 6,341,738 | B1 | 1/2002 | Coles |
| 6,367,710 | B2 | 4/2002 | Fan |
| 6,367,711 | B1 | 4/2002 | Benoist |
| 6,368,503 | B1 | 4/2002 | Williamson et al. |
| 6,370,713 | B2 | 4/2002 | Bosio |
| 6,382,529 | B1 | 5/2002 | Wu |
| 6,415,958 | B1 | 7/2002 | Donley |
| 6,427,931 | B1 | 8/2002 | Guo |
| 6,431,468 | B1 | 8/2002 | Brown et al. |
| 6,454,186 | B2 | 9/2002 | Haverstraw et al. |
| 6,454,187 | B1 | 9/2002 | Wang |
| 6,460,782 | B1 | 10/2002 | Wang |
| 6,467,104 | B1 | 10/2002 | Shieh |
| 6,471,141 | B2 | 10/2002 | Smith et al. |
| 6,484,953 | B2 | 11/2002 | Frier |
| 6,502,768 | B2 | 1/2003 | Chang |
| 6,508,415 | B2 | 1/2003 | Wang |
| 6,520,427 | B1 | 2/2003 | Chen |
| 6,540,159 | B1 | 4/2003 | Wang |
| 6,540,163 | B1 | 4/2003 | Huang |
| 6,561,210 | B2 | 5/2003 | Hsieh et al. |
| 6,561,441 | B1 | 5/2003 | Hsieh |
| 6,568,605 | B1 | 5/2003 | Chen |
| 6,575,387 | B1 | 6/2003 | Baker |
| 6,592,057 | B1 | 7/2003 | Ericksen et al. |
| 6,595,440 | B2 | 7/2003 | Moriarity et al. |
| 6,612,507 | B1 | 9/2003 | Meyer et al. |
| 6,622,945 | B1 | 9/2003 | Wu |
| 6,634,573 | B2 | 10/2003 | Bosch et al. |
| 6,641,060 | B2 | 11/2003 | Bratolli et al. |
| 6,641,061 | B1 | 11/2003 | Hsieh |
| 6,644,333 | B2 | 11/2003 | Gloodt |
| 6,659,373 | B1 | 12/2003 | Heren et al. |
| 6,663,022 | B1 | 12/2003 | Baker |

| | | | | |
|---|---|---|---|---|
| 6,685,110 | B2 | 2/2004 | Wang et al. | |
| 6,691,933 | B1 | 2/2004 | Bosio | |
| 6,691,937 | B2 | 2/2004 | Heren et al. | |
| 6,719,219 | B1 | 4/2004 | Wang | |
| 6,738,996 | B1 | 5/2004 | Malek et al. | |
| 6,739,523 | B2 | 5/2004 | Haverstraw et al. | |
| 6,749,135 | B2 | 6/2004 | Groblebe et al. | |
| 6,757,921 | B2 | 7/2004 | Esche | |
| 6,796,515 | B2 | 9/2004 | Heren et al. | |
| 6,808,130 | B1 * | 10/2004 | Ouyoung | 239/441 |
| 6,808,131 | B2 | 10/2004 | Bosio | |
| 6,811,099 | B2 | 11/2004 | Krestine et al. | |
| 6,860,438 | B1 | 3/2005 | Huang | |
| 6,866,208 | B2 | 3/2005 | Kao | |
| 6,880,768 | B2 | 4/2005 | Lau | |
| 6,915,967 | B1 | 7/2005 | Chen | |
| 6,921,032 | B2 | 7/2005 | Habermacher et al. | |
| 6,945,474 | B1 | 9/2005 | Chen | |
| 6,962,298 | B1 | 11/2005 | Martin | |
| 6,981,661 | B1 | 1/2006 | Chen | |
| 7,000,626 | B1 | 2/2006 | Cress | |
| 7,000,854 | B2 | 2/2006 | Malek et al. | |
| 2001/0020302 | A1 | 9/2001 | Bosio | |
| 2002/0185553 | A1 | 12/2002 | Benstead et al. | |
| 2002/0190141 | A1 | 12/2002 | Huang | |
| 2003/0042331 | A1 | 3/2003 | Lu | |
| 2003/0042337 | A1 | 3/2003 | Liang et al. | |
| 2003/0125842 | A1 | 7/2003 | Chang et al. | |
| 2003/0127541 | A1 | 7/2003 | Marino | |
| 2003/0173423 | A1 | 9/2003 | Haenlein et al. | |
| 2003/0189111 | A1 | 10/2003 | Heren et al. | |
| 2004/0010848 | A1 | 1/2004 | Esche | |
| 2004/0060308 | A1 | 4/2004 | Yoshizawa et al. | |
| 2004/0088786 | A1 * | 5/2004 | Malek et al. | 4/677 |
| 2004/0112985 | A1 | 6/2004 | Malek et al. | |
| 2004/0155460 | A1 | 8/2004 | Nobili | |
| 2004/0164183 | A1 | 8/2004 | Nobili | |
| 2004/0173688 | A1 | 9/2004 | Gloodt | |
| 2004/0222320 | A1 | 11/2004 | Wu | |
| 2004/0227014 | A1 | 11/2004 | Williams et al. | |
| 2005/0103897 | A1 | 5/2005 | Cannon et al. | |
| 2005/0121542 | A1 | 6/2005 | Su Lim | |
| 2005/0145554 | A1 | 7/2005 | Cunningham et al. | |
| 2005/0161533 | A1 | 7/2005 | Nobili | |
| 2005/0178857 | A1 | 8/2005 | Roman | |
| 2005/0178858 | A1 | 8/2005 | Roman | |
| 2005/0189438 | A1 | 9/2005 | Bosio | |
| 2005/0204462 | A1 | 9/2005 | Cotton et al. | |
| 2005/0242210 | A1 | 11/2005 | Heren et al. | |
| 2006/0016912 | A1 | 1/2006 | Nobili | |
| 2006/0022071 | A1 | 2/2006 | Burnworth et al. | |
| 2006/0117477 | A1 | 6/2006 | Rosko | |
| 2006/0214016 | A1 | 9/2006 | Erdely et al. | |
| 2006/0255167 | A1 | 11/2006 | Vogel et al. | |
| 2007/0194148 | A1 | 8/2007 | Rosko et al. | |
| 2008/0067264 | A1 * | 3/2008 | Erickson et al. | 239/445 |

FOREIGN PATENT DOCUMENTS

| | | |
|---|---|---|
| DE | 3643320 | 7/1988 |
| EP | 0 251 990 | 1/1988 |
| EP | 0 337 367 | 10/1989 |
| EP | 0 809 539 | 12/1997 |
| EP | 0 933 136 | 8/1999 |
| EP | 0 975 432 | 2/2000 |
| EP | 1 132 141 | 9/2001 |
| EP | 1 354 634 | 10/2003 |
| EP | 1 418 007 | 5/2004 |
| EP | 1 598 116 | 11/2005 |
| GB | 1452974 | 10/1976 |
| GB | 1 555 003 | 11/1979 |
| GB | 2 171 175 | 8/1986 |
| JP | 02-052061 | 2/1990 |
| JP | 10230192 | 9/1998 |
| JP | 11021956 | 1/1999 |
| JP | 2000027247 | 1/2000 |
| WO | WO 80/01940 | 9/1980 |
| WO | WO 86/06654 | 11/1986 |
| WO | WO 96/25237 | 8/1996 |
| WO | WO 98/46366 | 10/1998 |
| WO | WO 00/32314 | 6/2000 |
| WO | WO 2004/104305 | 12/2004 |
| WO | WO 2005/018814 | 3/2005 |
| WO | WO 2005/115554 | 12/2005 |

* cited by examiner

FAUCET SPRAY HEAD

CROSS-REFERENCE TO RELATED APPLICATIONS

This application claims priority to Chinese Patent Application No. 200620066768.X, filed on Oct. 25, 2006, and Chinese Patent Application No. 200620066769.4, filed on Oct. 25, 2006, the disclosures of which are expressly incorporated by reference herein.

FIELD OF THE INVENTION

The present utility model relates to a faucet, particularly to a pull-out type faucet spray gun arrangement.

BACKGROUND AND SUMMARY OF THE INVENTION

Conventional faucets are disposed as being fixed and comprise a faucet body, one or more flow control/mixing valves and one or more control handles. In this case, the discharge of water is activated at a fixed point, or the faucet is rotated in a predetermined horizontal range to discharge water. To facilitate flexible use of a faucet, a pull-out type faucet spray gun has been developed, wherein a hose is connected to an outlet pipe of a fixed faucet for connection to a faucet spray gun so that the faucet can be flexibly used in a relatively large range.

However, the faucet spray guns in the present market often only have a single waterway to discharge water. As such, the press switch or trigger only functions to control the amount of water flow, and cannot function to control water-out states of the faucet, such as shift to sprinkler style (spray) or bubble style (aerated stream).

According to an illustrative faucet spray gun arrangement of the present disclosure, a shift between two outlet waterways can be realized by means of an activation press handle or trigger to assist a nozzle in realizing selection among a plurality of water-out states.

According to one illustrative embodiment, a faucet spray gun arrangement comprises a spray gun body, a spray gun press handle, a spray gun inner core tube and a control means or assembly, the spray gun press handle being movably fixed on the spray gun body, the spray gun inner core tube being disposed in the spray gun body, and the control assembly engaging with the spray gun inner core tube and the spray gun press handle, wherein two outlet waterways are provided in the spray gun inner core tube, and the control assembly is provided with a movable central pin controlling and shifting the two outlet waterways of the spray gun inner core tube respectively.

A receiving chamber is provided in the spray gun body to receive the spray gun inner core tube, and is connected at its lower end to a water inlet tube and at its upper end to an outlet nozzle. An open area is provided in a front portion of the spray gun body to receive the spray gun press handle.

The spray gun inner core tube is fixed in the spray gun body via an anti-release snap ring.

The spray gun press handle is shaped in response to the position of the open area of the spray gun body and provided at its upper end with a lug outside of which a limiting face is formed. The lug is embedded in the upper end of the open area of the spray gun body.

The spray gun press handle is formed at its lower end with an end face on which a recess is disposed.

The spray gun press handle is formed at its lower end with an end face on which an inner side a limiting snap hook is provided.

The spray gun inner core tube includes a lower core tube and an upper core tube. A water inlet port is provided at the lower portion of the lower core tube, and an accommodating seat and a water outlet pipeline are formed in the upper portion thereof. A water inlet port is provided in the side wall of the accommodating seat, and a sink cavity is formed in the middle portion of the lower core tube in the direction facing the spray gun press handle. The interior of the sink cavity is designed as a stepped configuration and the middle portion is communicated with the water outlet pipeline. A protruding post is formed at the bottom of the sink cavity. The upper core tube forms first and second outlet waterways. A stepped sink cavity is formed in the longitudinal direction of the lower portion of the upper core tube. In the middle portion at the left side of the sink cavity are provided a water inlet port communicated with the first outlet waterway and the above mentioned water inlet port; in the upper portion at the right side of the sink cavity is provided a water inlet port communicated with the second outlet waterway. Closely adjacent to the water inlet port and on the right side wall of the sink cavity is provided a water inlet port communicated with the water outlet pipeline of the lower core tube.

A protruding post or a groove is formed on the bottom of the sink cavity of the lower core tube; a protruding post or a groove is formed on the upper portion of the sink cavity of the upper core tube.

The control assembly comprises a switch means or assembly and a shift means or assembly.

The switch assembly comprises a switch central pin, a central pin guide sleeve and a return spring; a post body is formed at the front portion of the switch central pin and mates with an inner cavity surface of the central pin guide sleeve. An inverted tapered post is formed in the middle portion of the switch central pin and has an outer diameter greater than the inner cavity diameter of the central pin guide sleeve and less than the inner diameter of a middle inner cavity of the sink cavity. A cylindrical surface is formed at the rear portion of the switch central pin and mates with the inner wall surface of the bottom of the sink cavity. A side wall of the central pin guide sleeve is provided with a water inlet port; the central pin guide sleeve is fixed at the front end of the sink cavity and its water inlet port is positioned in alignment with a water outlet pipeline opening in the upper portion of the sink cavity. The rear end of the return spring is disposed around a protruding post on the bottom of the sink cavity or embedded in a groove on the bottom of the sink cavity, and the front end of the return spring abuts in a counterbore or on a protruding post formed at the rear end of the switch central pin.

An abutting head is disposed at the front end of the central pin, and an embedding groove is provided on the inner wall surface of the spray gun press handle corresponding to the abutting head.

The shift assembly comprises a shift central pin and a return spring; a tapered post is formed in the upper portion of the shift central pin and has an outer diameter greater than the inner cavity diameter of the upper portion of sink cavity and the inner cavity diameter of the accommodating seat of the lower core tube. A cylindrical body is formed in the lower portion of the shift central pin and accommodated in the accommodating seat of the lower core tube. The upper end of the return spring is disposed around the protruding post in the upper portion of the sink cavity or embedded in a groove in the upper portion of the sink cavity, and the lower end thereof abuts in a counterbore or protruding post formed in the upper end of the shift central pin.

One side of the lower portion of the shift central pin of the shift assembly engages with a shift lever lower portion, and the middle portion of the shift lever is embedded on the side wall of the lower core tube.

The control assembly is fixed on the spray gun inner core tube via a central pin snap ring.

According to an illustrative embodiment, the spray gun inner core tube in the faucet spray gun body is provided with the first and second outlet waterways, and the control assembly is activated by pressing the spray gun press handle to shift the water outlet ports of the two outlet waterways to realize entry of two waterways into the nozzle arrangement and realize adjustment of passive water-out states by cooperating with the two kinds of water-out configurations of the nozzle, thereby fulfilling the function of making adjustments depending on a desired amount of water to be needed. Furthermore, the control assembly totally depends on the amount of the strokes of the spray gun press handle to realize shifting so that a single hand can operate the spray gun to achieve an effect of convenient control and operation.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiment selected for description have been chosen to enable one skilled in the art to practice the invention.

Figure 1:
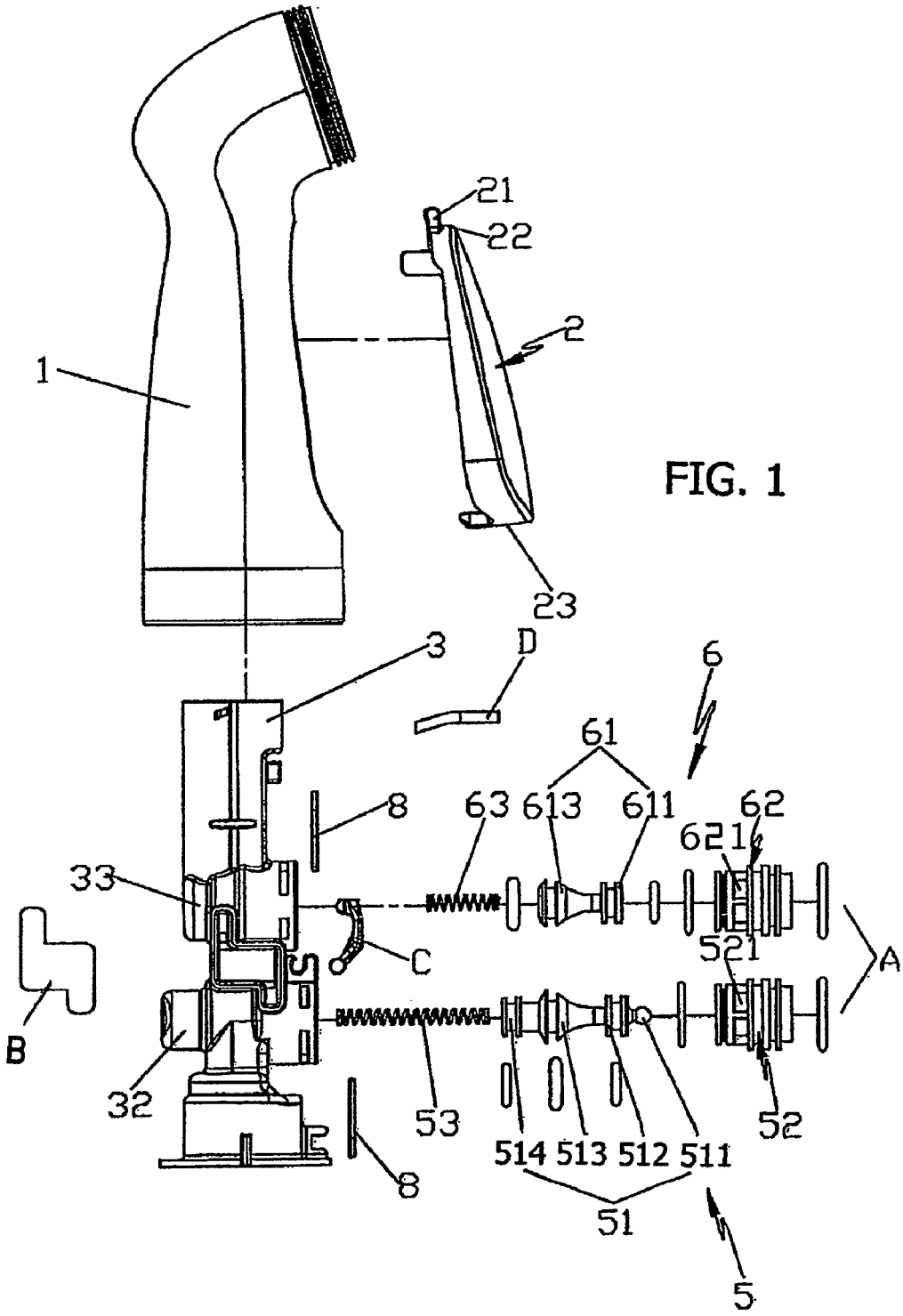
FIG. 1 is an exploded view of a first illustrative embodiment of the faucet spray head.

Referring initially to FIG. 1, a faucet spray gun arrangement according to present disclosure generally mainly comprises a spray gun body 1, a spray gun press handle 2, a spray gun inner core tube 3 and a control means or assembly A, wherein the control means A is combined together with the spray gun inner core tube 3. The upper end of the spray gun press handle 2 is movably pivoted to the spray gun body 1 so that the spray gun press handle 2 can make in-out motion on the spray gun body 1 to push the control means A to open or close a water outlet way of the spray gun inner core tube 3. The spray gun inner core tube 3 is provided with two waterways to engage a nozzle having two spray patterns (not shown).

Figure 2:
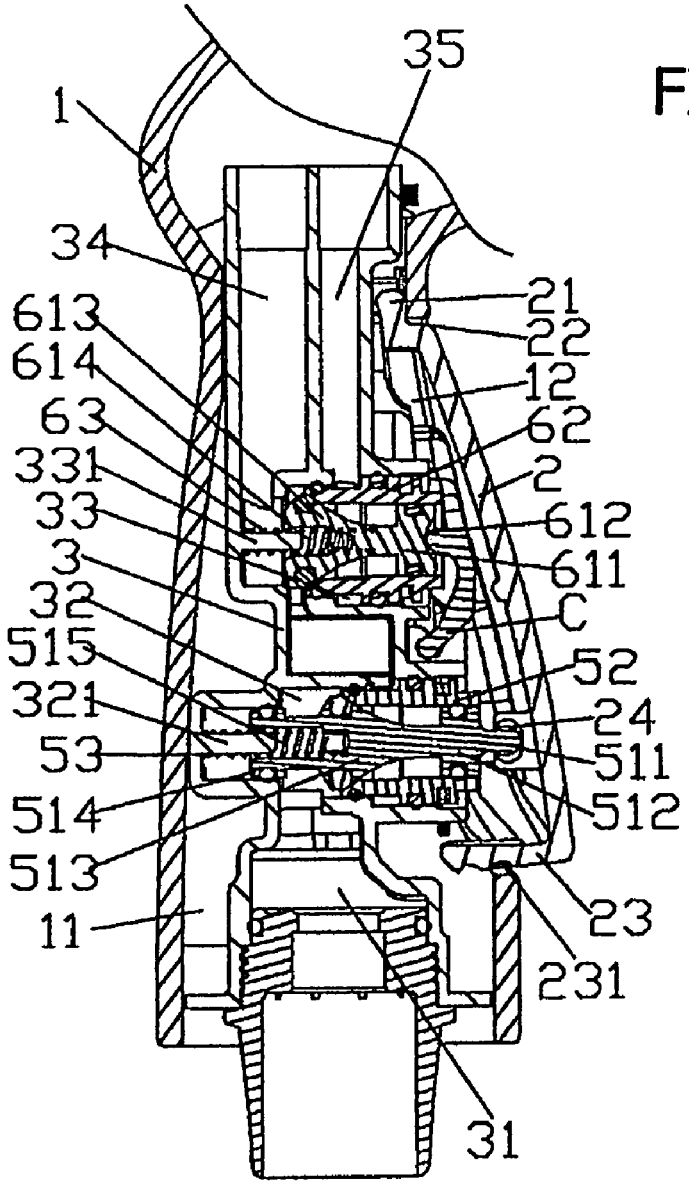
FIG. 2 is a combined sectional view of the faucet spray head of FIG. 1 (in a closed state)

As shown in FIGS. 1 and 2, a first illustrative embodiment faucet spray gun body of the present disclosure comprises a spray gun body 1, a spray gun press handle or trigger 2, a spray gun inner core tube 3 and control means A.

A receiving chamber 11 is provided in the spray gun body 1 to receive the spray gun inner core tube 3, and is connected at its lower end to a water inlet tube and at its upper end to a water outlet nozzle. An open area 12 is provided in a front portion of the spray gun body 1 to receive the spray gun press handle 2 such that the handle 2 may be pressed by the fingers of a user holding the body 1.

The spray gun press handle 2 is shaped in response to the position of the open area 12 of the spray gun body and provided at its upper end with a lug 21 outside of which a limiting face 22 is formed. The lug 21 is embedded in the upper end of the open area 12 of the spray gun body so that the lower portion of the spray gun press handle 2 can move forward and backward at the fixing point of the lug 21. The spray gun press handle 2 is provided at its lower end with an end face 23 on which a recess 231 is disposed.

A water inlet port 31 is provided at the lower portion of the spray gun inner core tube 3, and lower and upper sink cavities 32, 33 are formed above the water inlet port 31 and in the direction facing towards the spray gun press handle 2. The interior of the two sink cavities 32, 33 are designed as a stepped configuration and side walls of the two sink cavities 32, 33 are provided with a water passageway. Two protruding posts 321, 331 (or two grooves) are formed at the bottom of the two sink cavities 32, 33. First and second outlet waterways 34, 35 are formed on the upper portion of the spray gun inner core tube 3 and respectively communicate with a middle portion and a rear portion of the sink cavity 33.

The control means A comprises switch means or assembly 5 and shift means or assembly 6.

The switch means 5 comprises a switch central pin 51, a central pin guide sleeve 52 and a return spring 53; an abutting head 511 is disposed at the front end of the switch central pin 51, and a post body 512 is formed at the rear portion of the abutting head 511 and mates with an inner cavity surface of the central pin guide sleeve 52. An inverted tapered post 513 is formed in the middle portion of the switch central pin 51 and has an outer diameter greater than the inner cavity diameter of the central pin guide sleeve 52 and less than the inner diameter of a middle inner cavity of the sink cavity 32. A cylindrical surface 514 is formed at the rear portion of the switch central pin 51 and mates with the inner wall surface of the bottom of the sink cavity 32. A side wall of the central pin guide sleeve 52 is provided with a water inlet port 521; the central pin guide sleeve 52 is fixed at the front end of the sink cavity 32 and its water inlet port 521 is positioned in alignment with a waterway port in the upper portion of the sink cavity 32. The rear end of the return spring 53 is disposed around the protruding post 321 of the bottom of the sink cavity 32 (or embedded in the groove), and the front end of the return spring 53 abuts in a counterbore 515 (or protruding post) formed at the rear end of the switch central pin 51.

The shift means 6 comprises a shift central pin 61, a central pin guide sleeve 62 and a return spring 63; a cylindrical body 611 is formed in the front portion of the shift central pin 61, and a positioning depression 612 is provided in the front end face of the cylindrical body 611. The cylindrical body 611 is adapted to cooperate with an inner cavity surface of the central pin guide sleeve 62. An inverted tapered post 613 is formed in the rear portion of the shift central pin 61 and has an outer diameter greater than the inner cavity diameter of the central pin guide sleeve 62 and the inner diameter of the cavity on the bottom of the sink cavity 33. A side wall of the central pin guide sleeve 62 is provided with a water inlet port 621 which is located in alignment with a waterway port in the upper portion of the sink cavity 33 communicating with outlet waterway 34. The rear end of the return spring 63 is disposed around the protruding post 331 of the bottom of the sink cavity 33 (or embedded in the groove), and the front end of the return spring 63 abuts in a counterbore 614 (or protruding post) formed at the rear end of the shift central pin 61.

As shown in FIG. 2, when the spray head is assembled, first of all the return spring 53, the switch central pin 51 and the central pin guide sleeve 52 of the switch means 5 are disposed in turn in the sink cavity 32 of the spray gun inner core tube 3. The switch means 5 is fixed onto the sink cavity 32 via a central pin snap ring 8. At the same time, the central pin guide sleeve 52 is fixed at the front portion of the sink cavity 32. The return spring 63, the shift central pin 61 and the central pin guide sleeve 62 of the shift means 6 are disposed in turn in the sink cavity 33 of the spray gun inner core tube 3. The shift means 6 is fixed onto the sink cavity 33 via a central pin snap ring 8. At the same time, the central pin guide sleeve 62 is fixed at the front portion of the sink cavity 33. Then, the spray gun inner core tube 3 assembled with the control means A is disposed in the receiving chamber 11 of the spray gun 1 and fixed therein via an anti-release snap ring D. At last, the lug 21 of the spray gun press handle 2 is embedded in the upper end of the open area 12 of the spray gun body so that the spray gun press handle 2 is snap fitted on the open area 12, whereupon the front portion of the switch central pin 51 of the switch means 5 projects out of the central pin guide sleeve 52 and then the abutting head 511 thereof is embedded in an embedding groove 24 on the inner wall surface of the spray gun press handle 2. The front end face of the shift central pin 61 of the shift means 6 abuts against a shift lever C which has a gap with the inner wall surface of the spray gun press handle 2. The shift lever C is at its lower end movably embedded on the spray gun inner core tube 3 between the two sink cavities 32, 33, and at its upper end positioned in the positioning depression 612 on the front end face of the shift central pin 61. Additionally, sealing means are provided at the location where the respective components of the control means A cooperate with the spray gun inner core tube 3. As such, the faucet spray gun body is finished. Referring to FIG. 2, when the spray gun press handle 2 is in a normal state, the switch central pin 51 of the switch means 5 is pressed against the return spring 53, the inverted tapered post 513 in the middle portion of the switch central pin 51 abuts against the rear end face of the central pin guide sleeve 52, thereby closing the inlet waterway where the inner cavity of the central pin guide sleeve 52 communicates with the water inlet port 31 of the spray gun inner core tube 3. At the same time, the shift central pin 61 of the shift means 6 is pressed against the return spring 63, the inverted tapered post 613 in the rear portion of the switch central pin abuts against the rear end face of the central pin guide sleeve 62, thereby closing the second outlet waterway 35, whereupon the first outlet waterway 34 is in an open state.

Figure 3:
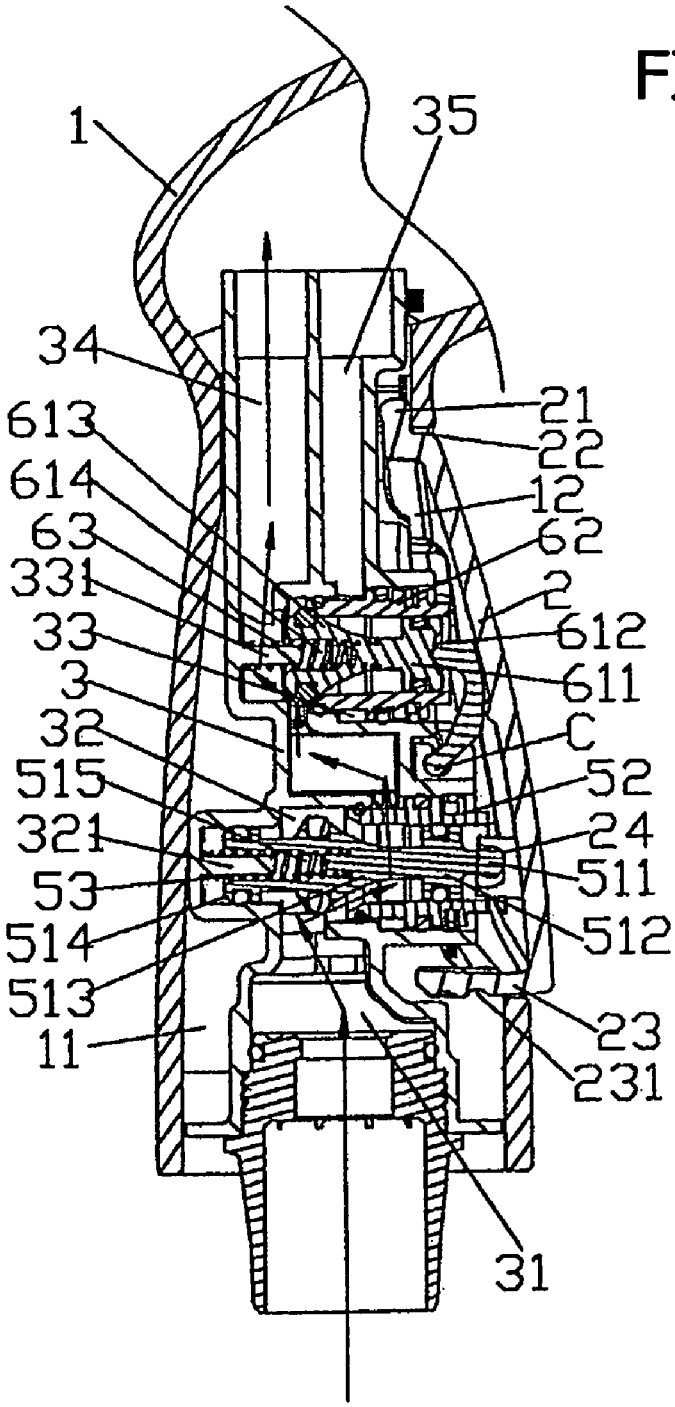
FIG. 3 is a sectional view showing entry of water in the first waterway of the faucet spray head of FIG. 1.

As shown in FIG. 3, when entry of water in the first waterway is controlled, the spray gun press handle 2 is held and pressed, the spray gun press handle 2 first pushes the switch central pin 51 to move backwards relative to the central pin guide sleeve 52. The inverted tapered post 513 of the switch central pin 51 moves away from the rear end face of the central pin guide sleeve 52, and the water inlet port of the central pin guide sleeve 52 is opened, whereupon the return spring 53 is in a compressed energy storing state. As indicated by the arrow in the figure, water flows upwardly along the spray gun inner core tube 3 and flows into the first outlet waterway 34 from the rear portion of the sink cavity 33 and into the nozzle arrangement corresponding to the first outlet waterway 34. When the spray gun press handle 2 is activated, the recess 231 on the lower end face 23 breaks away from the spray gun body 1 snap fitted therewith so that there is a manual sense of activation when the spray gun press handle 2 is pressed.

Figure 4:
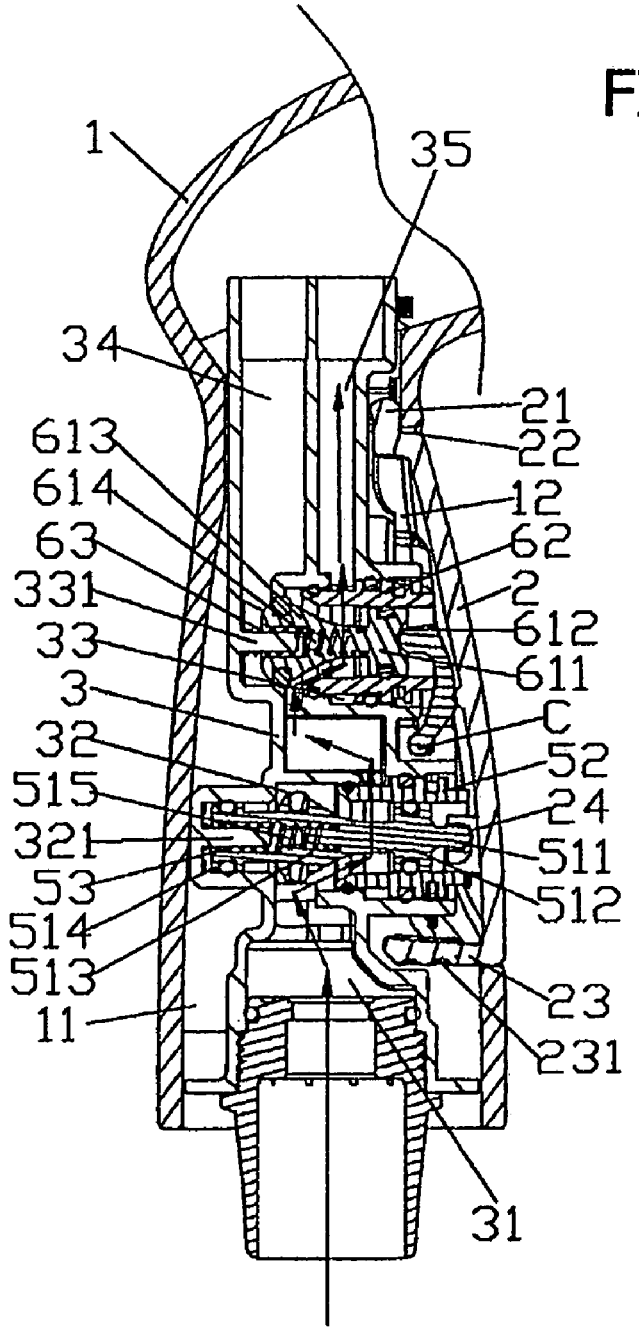
FIG. 4 is a sectional view showing entry of water in the second waterway of the faucet spray head of FIG. 1.

As shown in FIG. 4, when entry of water in the second waterway is controlled, the spray gun press handle 2 is further applied a force and held and pressed. When the spray gun press handle 2 moves to a limiting position, the switch central pin 51 of the switch means 5 further moves backward and the waterway of the sink cavity 32 is still in an open state. But at this time, the inner wall surface of the spray gun press handle 2 can be pressed to the shift lever C. The shift lever C pushes the shift central pin 61 of the shift means 6 to move relative to the central pin guide sleeve 62. The inverted tapered post 613 of the shift central pin 61 moves away from the rear end face of the central pin guide sleeve 62, and the water inlet port of the central pin guide sleeve 62 is opened, whereupon the lower end face of the shift central pin 61 closes the bottom of the sink cavity 33 and the water inlet port of the first outlet waterway 34, and the return spring 63 is in a compressed energy storing state. As indicated by the arrow in the figure, water flows upwardly along the spray gun inner core tube 3 and flows into the second outlet waterway 35 from the middle portion of the sink cavity 33 and into the nozzle arrangement corresponding to the second outlet waterway 35.

Referring to FIG. 2, the spray gun press handle 2 is loosened, the spray gun press handle 2 is pressed back to the original activation state under the action of the return spring 53, 63 in the control means A and due to provision of the limiting face 22 on the spray gun press handle 2, whereupon the waterway is in a closed state.

Figure 5:
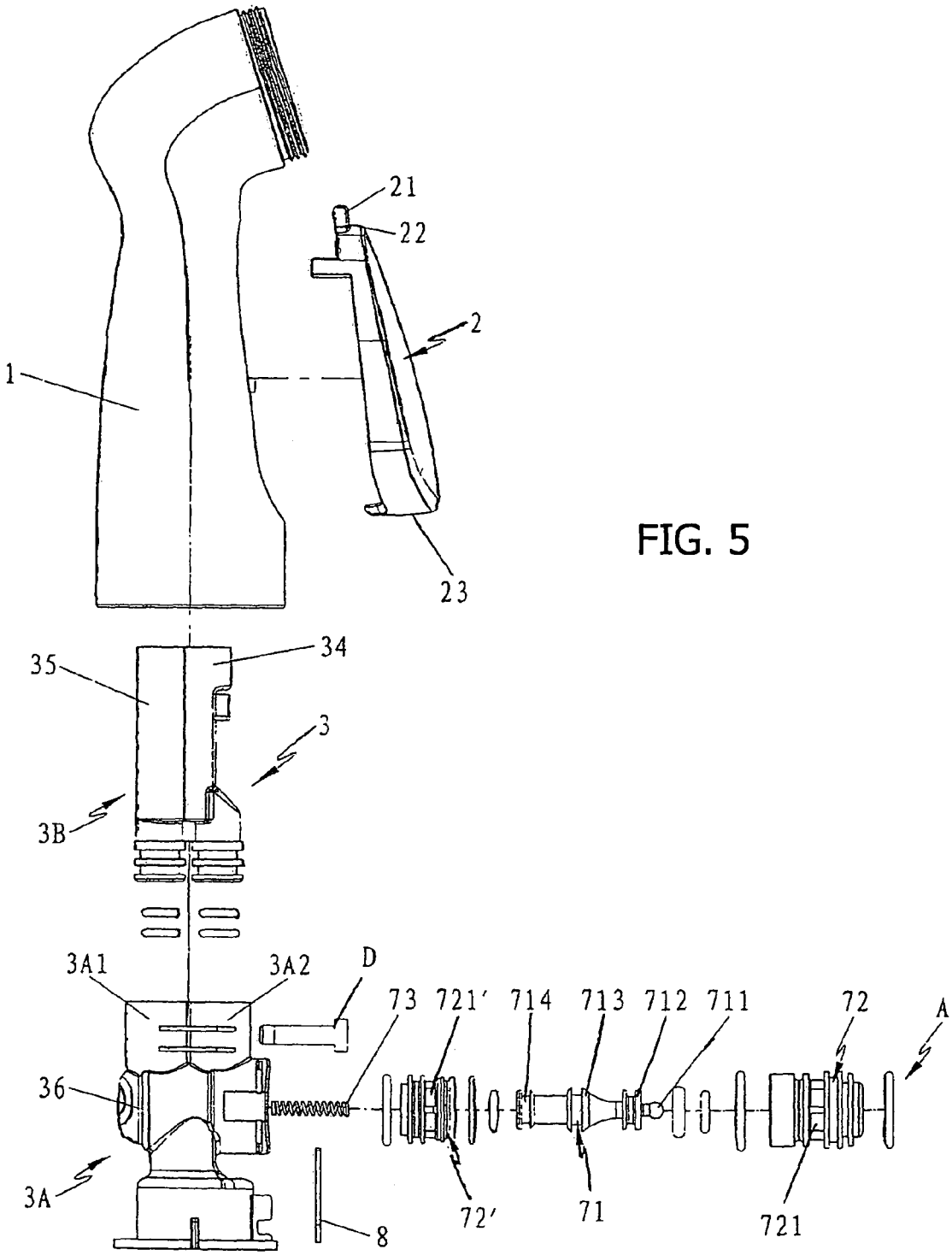
FIG. 5 is an exploded view of a second illustrative embodiment faucet spray head.
Figure 6:
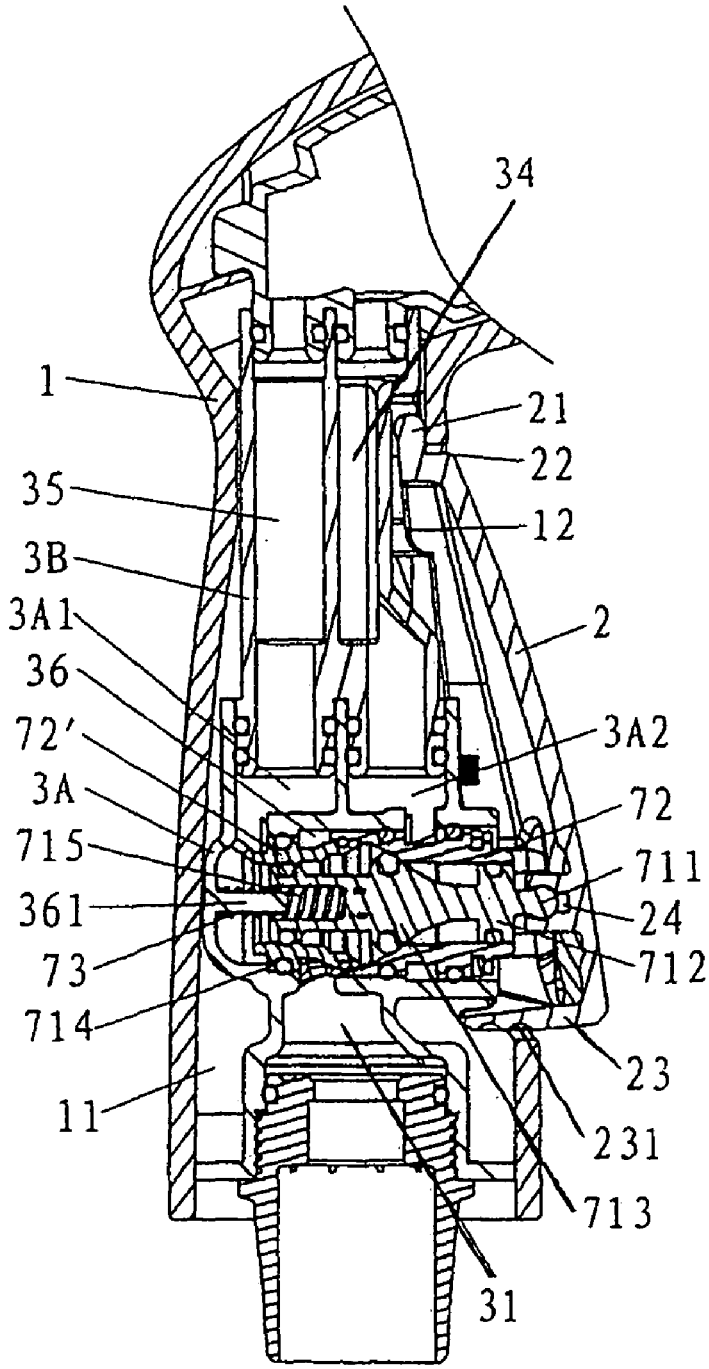
FIG. 6 is a combined sectional view of the faucet spray head of FIG. 5 (in a closed state)

As shown in FIGS. 5 and 6, the faucet spray gun body according to a second illustrative embodiment of the present disclosure also comprises a spray gun body 1, a spray gun press handle 2, a spray gun inner core tube 3 and control means A.

A receiving chamber 11 is provided in the spray gun body 1 to receive the spray gun inner core tube 3, and is connected at its lower end to a water inlet tube and at its upper end to a water outlet nozzle. An open area 12 is provided in a front portion of the spray gun body 1 to receive the spray gun press handle such that the handle 2 may be pressed by the fingers of a user holding the body 1.

The spray gun press handle 2 is shaped in response to the position of the open area 12 of the spray gun body and provided at its upper end with a lug 21 outside of which a limiting face 22 is formed. The lug 21 is embedded in the upper end of the open area 12 of the spray gun body so that the lower portion of the spray gun press handle 2 can move forward and backward at the fixing point of the lug 21. The spray gun press handle 2 is provided at its lower end with an end face 23 on which a recess 231 is disposed.

The spray gun inner core tube 3 includes a lower core tube 3A and an upper core tube 3B which can be separately formed or integrally formed. A water inlet port 31 is provided at the lower portion of the lower core tube 3A, a left water outlet port 3A1 and a right water outlet port 3A2 are provided in the upper portion of the lower core tube 3A and are respectively connected to the upper core tube 3B having first and second outlet waterways 34, 35. A sink cavity 36 is formed in the direction where the lower core tube 3A faces towards the spray gun press handle 2. The interior of the sink cavity 36 is designed as a stepped configuration and provided with two channels communicating with the water outlet ports 3A1, 3A2 at the middle portion and the bottom portion. Besides, a protruding post 361 (or groove) is formed on the bottom of the sink cavity 36.

Control means A comprises a central pin 71, front and rear central pin guide sleeves 72, 72' and a return spring 73. An abutting head 711 is disposed at the front end of the central pin 71, and a post body 712 is formed at the rear portion of the abutting head 711 and mates with an inner cavity surface of the front central pin guide sleeve 72. An inverted tapered post 713 is formed in the middle portion of the central pin 71 and has an outer diameter greater than the inner cavity diameter of the front central pin guide sleeve 72 and the inner cavity diameter of the rear central pin guide sleeve 72'. A cylindrical body 714 is formed at the rear portion of the central pin 71 and mates with the inner cavity surface of the rear central pin guide sleeve 72'. A side wall of the front central pin guide sleeve 72 is provided with a water inlet port 721 which is positioned in alignment with a waterway port in the middle portion of the sink cavity 36 communicating with the right water outlet port 3A2. The rear central pin guide sleeve 72' is provided at its side wall with a water inlet port 721' communicated with the water inlet port 31 disposed in the lower portion of the lower core tube 3A; the inner cavity of the rear central pin guide sleeve 72' can communicate with the left water outlet port 3A1. The two central pin guide sleeves 72, 72' are respectively fixed at the front end and the middle-rear portion of the sink cavity 36 and fixed together with one around the other. The rear end of the return spring 73 is disposed around the protruding post 361 of the bottom of the sink cavity 36 (or embedded in the groove), and the front end of the return spring abuts in a counterbore 715 (or protruding post) formed at the rear end of the central pin 71.

As shown in FIG. 6, when the spray head is assembled, first of all the return spring 73, the switch central pin 71 and the two central pin guide sleeves 72', 72 of the control means A are disposed in turn in the sink cavity 36 of the spray gun lower inner core tube 3A. The control means A is fixed onto the sink cavity 36 via a central pin snap ring 8. At the same time, the two central pin guide sleeves 72', 72 are fixed in the sink cavity 36. Then the lower core tube 3A is fixed with the upper core tube 3B. Then, the spray gun inner core tube 3 assembled with the control means A is disposed in the receiving chamber 11 of the spray gun 1 and fixed therein via a spray gun anti-release snap ring D. At last, the lug 21 of the spray gun press handle 2 is embedded in the upper end of the open area 12 of the spray gun body so that the spray gun press handle 2 is snap fitted on the open area 12, whereupon the front portion of the central pin 71 of the control means A projects out of the front central pin guide sleeve 72 and then the abutting head 711 thereof is embedded in an embedding groove 24 on the inner wall surface of the spray gun press handle 2. Additionally, sealing means are provided at the location where the respective components of the control means A cooperate with the spray gun inner core tube 3 and the lower core tube 3A is connected with the upper core tube 3B. As such, the faucet spray gun body is finished. Referring to FIG. 6, when the spray gun press handle 2 is in a normal state, the central pin 71 of the control means A is pressed against the return spring 73, the inverted tapered post 713 in the middle portion of the central pin 71 abuts against the rear end face of the front central pin guide sleeve 72, thereby closing the waterway of the right water outlet port 3A2. At the same time, the cylindrical body 714 in the rear portion of the central pin 71 is disposed in the rear central pin guide sleeve 72' to close the waterway of the left water outlet port 3A1. As such, the first and second outlet waterways 34, 35 are both in a closed state.

Figure 7:
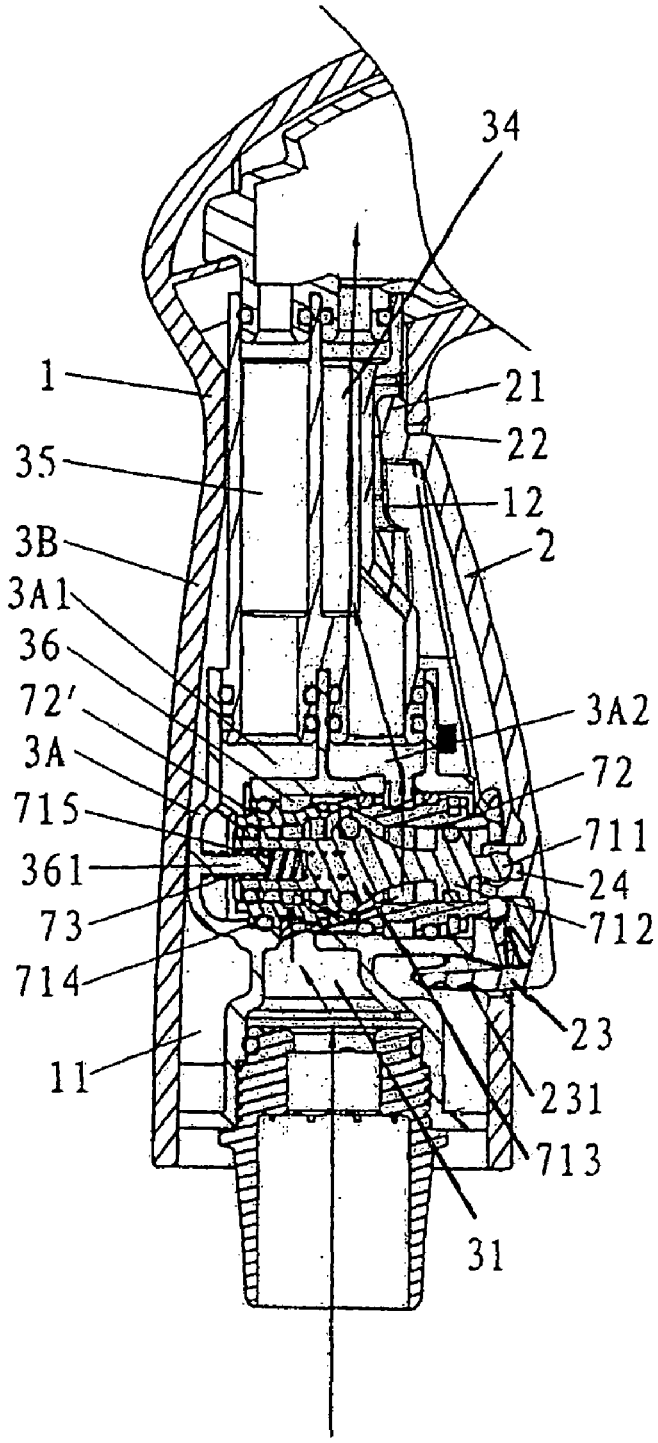
FIG. 7 is a sectional view showing entry of water in the first waterway of the faucet spray head of FIG. 5.

As shown in FIG. 7, when entry of water in the first waterway is controlled, the spray gun press handle 2 is held and pressed, the spray gun press handle 2 first pushes the central pin 71 of the control means A to move backwards relative to the two central pin guide sleeves 72, 72'. The inverted tapered post 713 of the central pin 71 moves away from the rear end face of the front central pin guide sleeve 72, and the water inlet port of the central pin guide sleeve 72 and the right water outlet port 3A2 are opened, whereupon the cylindrical body 714 is still in the inner cavity of the rear central pin guide sleeve 72' and encloses the inner cavity. In the meantime, the return spring 73 is in a compressed energy storing state. As indicated by the arrow in the figure, water flows upwardly along the spray gun lower inner core tube 3A and flows from the sink cavity 36 into the right water outlet port 3A2 into the first outlet waterway 34 and into the nozzle arrangement corresponding to the first outlet waterway 34. When the spray gun press handle 2 is activated, the recess 231 on the lower end face 23 breaks away from the spray gun body 1 snap fitted therewith so that there is a manual sense of activation when the spray gun press handle 2 is pressed.

Figure 8:
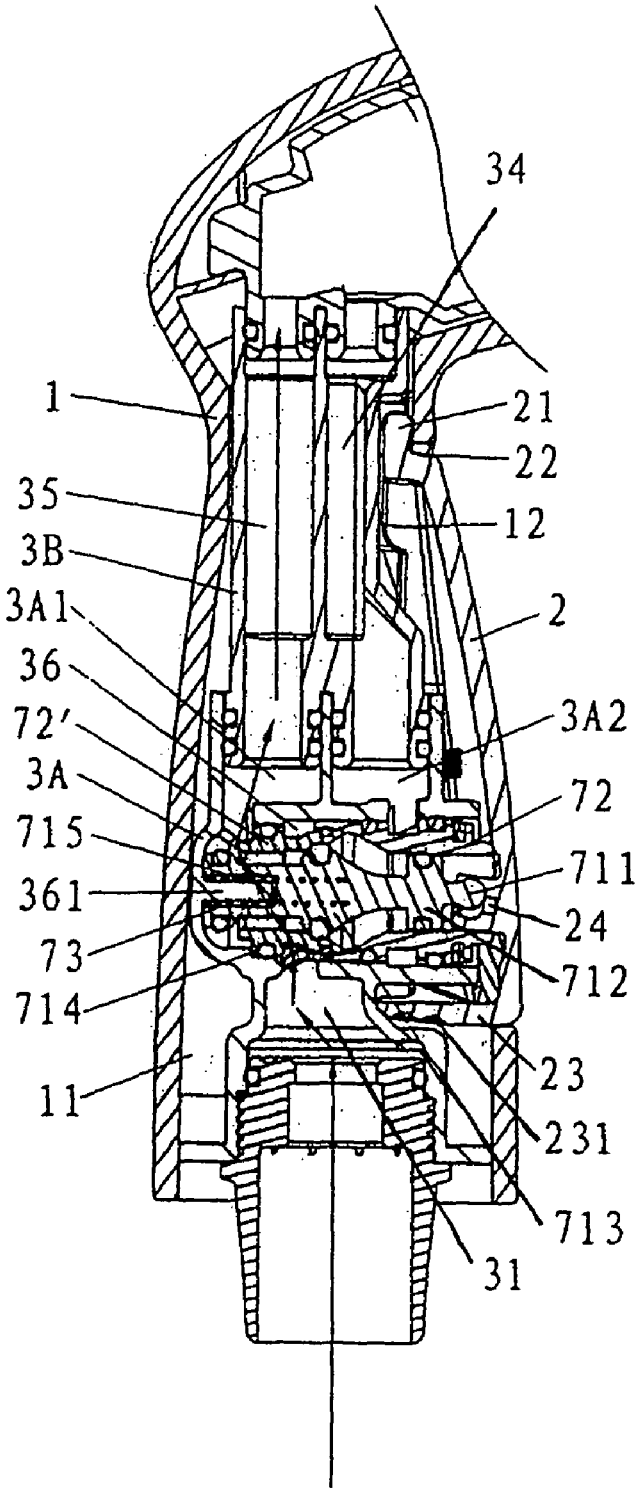
FIG. 8 is a sectional view showing entry of water in the second waterway of the faucet spray head of FIG. 5.

As shown in FIG. 8, when entry of water in the second waterway is controlled, and the spray gun press handle 2 is further applied a force and held and pressed, the spray gun press handle 2 further moves the central pin 71 of the control means A to move backward to a limiting position, the inverted tapered post 713 of the central pin 71 abuts against the front end face of the rear central pin guide sleeve 72' and encloses the inner cavity thereof communicated with the front central pin guide sleeve 72, and the water inlet port of the front central pin guide sleeve 72 is in a closed state, that is, water cannot flow into the right water outlet port 3A2 into the first outlet waterway 34. At this time, the cylindrical body 714 in the rear portion of the central pin 71 moves away from the inner cavity of the rear central pin guide sleeve 72', and the left outlet waterway 3A1 communicated with the inner cavity of the rear central pin guide sleeve 72' is opened. As indicated by the arrow in the figure, water flows upwardly along the spray gun lower inner core tube 3A and flows into the left water outlet port 3A1 from the sink cavity 36 into the second outlet waterway 35 and into the nozzle arrangement corresponding to the second outlet waterway 35.

Referring to FIG. 6, the spray gun press handle 2 is loosened, the spray gun press handle 2 is pressed back to the original activation state under the action of the return spring 73 in the control means A and due to provision of the limiting face 22 on the spray gun press handle 2, whereupon the two waterways are both in a closed state.

Figure 9:
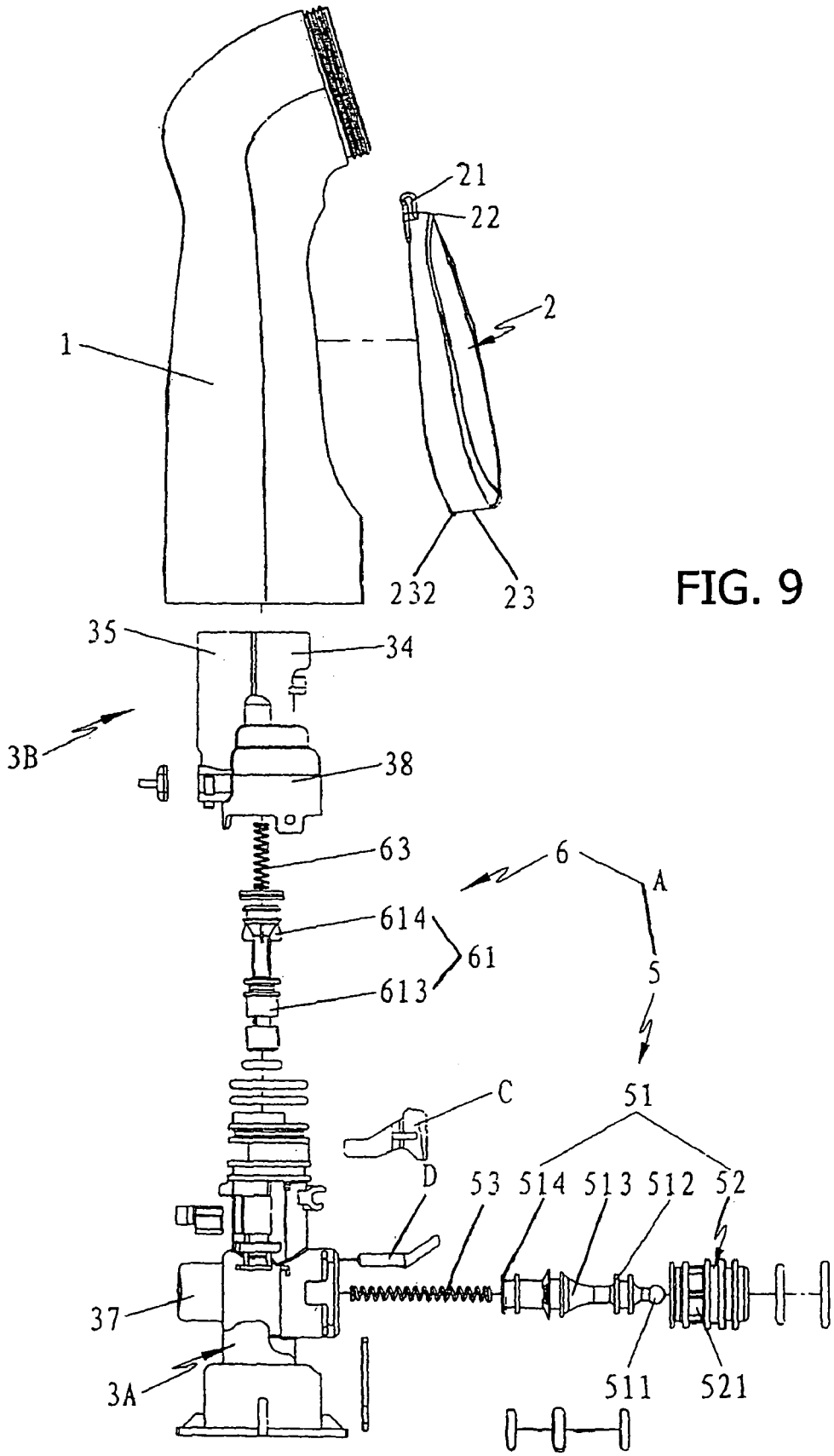
FIG. 9 is an exploded view of a third illustrative embodiment faucet spray head.
Figure 10:
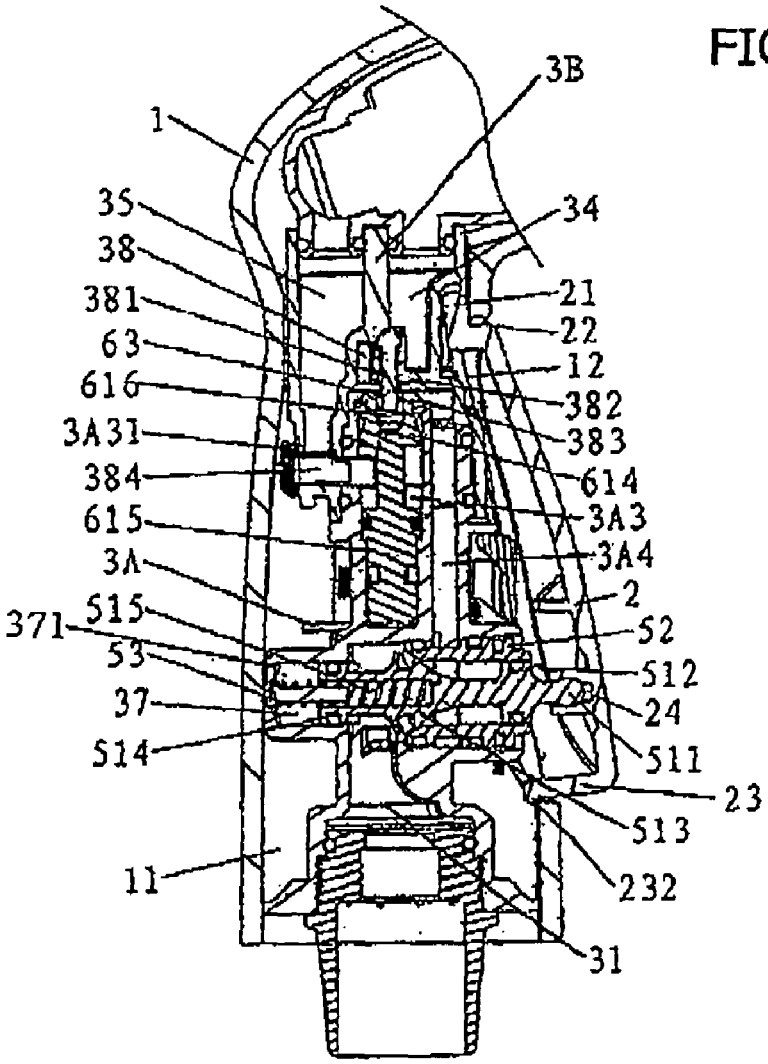
FIG. 10 is a combined sectional view of the faucet spray head of FIG. 9 (in a closed state)

As shown in FIGS. 9 and 10 the faucet spray gun according to a third illustrative embodiment of the present disclosure also comprises a spray gun body 1, a spray gun press handle 2, a spray gun inner core tube 3 and control means or assembly A.

A receiving chamber 11 is provided in the spray gun body 1 to receive the spray gun inner core tube 3, and is connected at its lower end to a water inlet tube and at its upper end to a water outlet nozzle. An open area 12 is provided in a front portion of the spray gun body 1 to receive the spray gun press handle such that the handle 2 may be pressed by the fingers of a user holding the body 1.

The spray gun press handle 2 is shaped in response to the position of the open area 12 of the spray gun body and provided at its upper end with a lug 21 outside of which a limiting face 22 is formed. The lug 21 is embedded in the upper end of the open area 12 of the spray gun body so that the lower portion of the spray gun press handle 2 can move forward and backward at the fixing point of the lug 21. The spray gun press handle 2 is provided at its lower end with an end face 23 on which inner side a snap hook 232 is disposed.

The spray gun inner core tube 3 includes a lower core tube 3A and an upper core tube 3B. A water inlet port 31 is provided at the lower portion of the lower core tube 3A, and an accommodating seat 3A3 and a water outlet pipeline 3A4 are formed in the upper portion thereof. A water inlet port 3A31 is provided in the side wall of the accommodating seat 3A3, and a sink cavity 37 is formed in the middle portion of the lower core tube 3A in the direction facing the spray gun press handle 2. The interior of the sink cavity 37 is designed as a stepped configuration and the middle portion is communicated with the water outlet pipeline. A protruding post 371 (or groove) is formed at the bottom of the sink cavity 37. Two outlet waterways 34, 35 are formed in the upper core tube 3B and a stepped sink cavity 38 is formed in the longitudinal direction of the lower portion of the upper core tube 3B. In the middle portion at the left side of the sink cavity 38 are provided a water inlet port 384 communicated with the outlet waterway 34 and the above mentioned water inlet port 3A31; in the upper portion at the right side of the sink cavity 38 is provided a water inlet port 382 communicated with the outlet waterway 35. Closely adjacent to the water inlet port 382 and on the right side wall of the sink cavity 38 is provided a water inlet port 383 communicated with the water outlet pipeline 3A4 of the lower core tube 3A. In addition, a protruding post 381 (or groove) is formed in the upper portion of the sink cavity 38.

The control means A comprises switch means or assembly 5 and shift means or assembly 6. As shown in FIG. 9, the switch means 5 is disposed perpendicular to the shift means 6. More particularly, the spring gun body 1 illustratively defines a vertical axis wherein the switch means 5 is movable in a direction perpendicular to the body axis (i.e. horizontal) and the shift means 6 is movable in a direction parallel to the body axis (i.e. vertical).

The switch means 5 comprises a switch central pin 51, a central pin guide sleeve 52 and a return spring 53; an abutting head 511 is disposed at the front end of the switch central pin 51, and a post body 512 is formed at the rear portion of the abutting head 511 and mates with an inner cavity surface of the central pin guide sleeve 52. An inverted tapered post 513 is formed in the middle portion of the switch central pin 51 and has an outer diameter greater than the inner cavity diameter of the central pin guide sleeve 52 and less than the inner diameter of a middle inner cavity of the sink cavity 37. A cylindrical surface 514 is formed at the rear portion of the switch central pin 51 and mates with the inner wall surface of the bottom of the sink cavity 37. A side wall of the central pin guide sleeve 52 is provided with a water inlet port 521; the central pin guide sleeve 52 is fixed at the front end of the sink cavity 37 and its water inlet port 521 is positioned in alignment with the water outlet pipeline port in the upper portion of the sink cavity 37. The rear end of the return spring 53 is disposed around the protruding post 371 of the bottom of the sink cavity 37, and the front end of the return spring 53 abuts in a counterbore 515 formed at the rear end of the switch central pin 51.

The shift means 6 comprises a shift central pin 61 and a return spring 63; a tapered post 614 is formed in the upper portion of the shift central pin 61 and has an outer diameter greater than the inner cavity diameter of the upper portion of sink cavity 38 and the inner cavity diameter of the accommodating seat 3A3 of the lower core tube 3A. A cylindrical body 615 is formed in the lower portion of the shift central pin 61 and accommodated in the accommodating seat 3A3 of the lower core tube 3A. The upper end of the return spring 63 is disposed around the protruding post 381 (or embedded in the groove) in the upper portion of the sink cavity 38, and the lower end thereof abuts in a counterbore 616 (or on a protruding post) formed in the upper end of the shift central pin 61.

As shown in FIG. 10, when the spray head is assembled, first of all the return spring 53, the switch central pin 51 and the central pin guide sleeve 52 of the switch means 5 are disposed in turn in the sink cavity 37 of the spray gun lower inner core tube 3A. The switch means 5 is fixed onto the sink cavity 37 via a central pin snap ring. The shift central pin 61 of the shift means 6 is disposed in the accommodating seat 3A3 of the spray gun lower inner core tube 3A, then the upper inner core tube 3B is fixed together with the lower inner core tube 3A, whereupon the return spring 63 and the tapered post 614 in the upper portion of the shift central pin 61 are accommodated in the sink cavity 38 of the upper core tube 3B. Then the spray gun inner core tube 3 assembled with the control means A is disposed in the receiving chamber 11 of the spray gun 1 and fixed therein by a welding plate B. At last, the lug 21 of the spray gun press handle 2 is embedded in the upper end of the open area 12 of the spray gun body so that the spray gun press handle 2 is snap fitted on the open area 12, whereupon the front portion of the switch central pin 51 of the switch means 5 projects out of the central pin guide sleeve 52 and then the abutting head 511 thereof is embedded in an embedding groove 24 on the inner wall surface of the spray gun press handle 2. One side of the lower portion of the shift central pin 61 of the shift means 6 engages with the lower portion of a shift lever C, and the middle portion of the shift lever C is embedded on the side wall of the lower core tube 3A. Additionally, sealing means are provided at the location where the respective components of the control means A cooperate with the spray gun inner core tube 3 and the location where the lower core tube 3A is connected with the upper core tube 3B. As such, the faucet spray gun body is finished.

Referring to FIG. 10, when the spray gun press handle 2 is in a normal state, the switch central pin 51 of the switch means 5 is pressed against the return spring 53, the inverted tapered post 513 in the middle portion of the switch central pin 51 abuts against the rear end face of the central pin guide sleeve 52, thereby closing the inlet waterway by which the inner cavity of the central pin guide sleeve 52 communicates with the water inlet port 31 of the lower core tube 3A. At the same time, the shift central pin 61 of the shift means 6 is pressed against the return spring 63, the tapered post 614 in the upper portion of the shift central pin 61 encloses the opening portion of the accommodating seat 3A3 of the upper core tube 3B when being abutted by the return spring 63, enclosing the water inlet port of the first outlet waterway 34. However, the two water inlet ports 382, 383 of the sink cavity 38 and the second outlet waterway 35 are in a communicated opened state.

Figure 11:
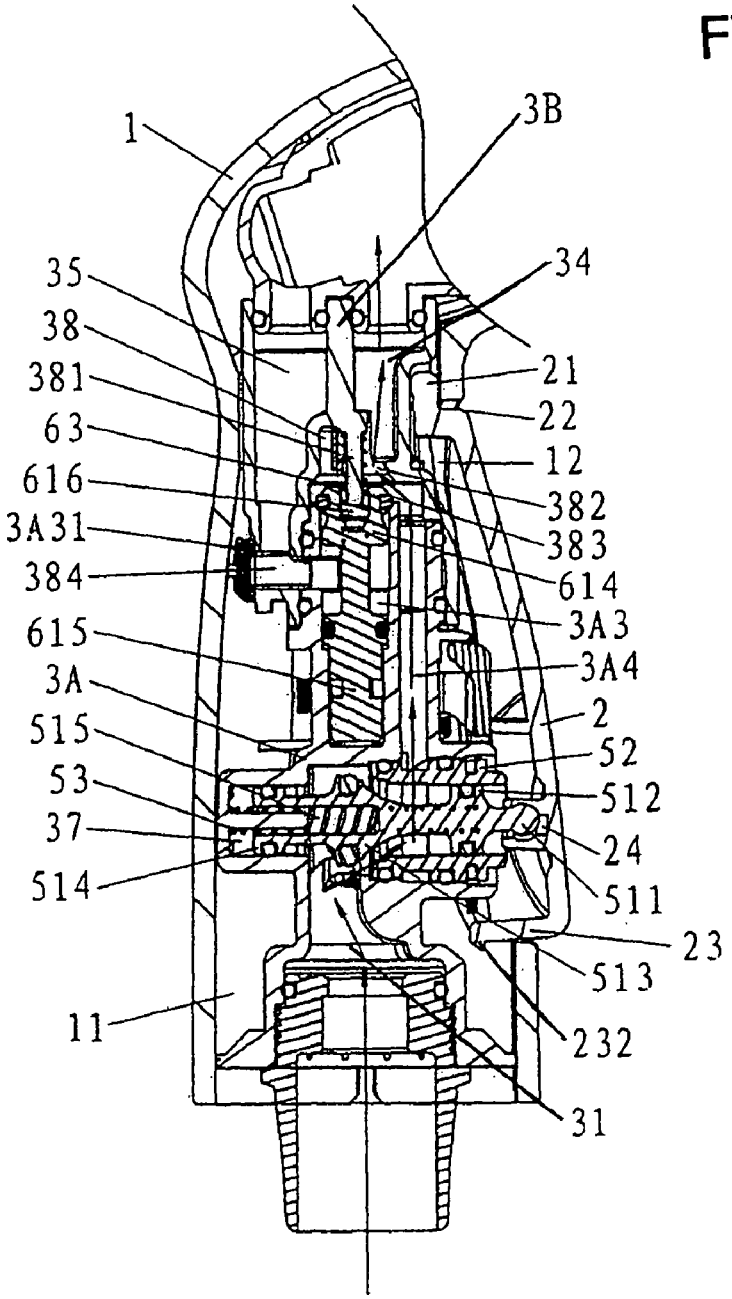
FIG. 11 is a sectional view showing entry of water in the first waterway of the faucet spray head of FIG. 9.

As shown in FIG. 11, when entry of water in the first waterway is controlled, the spray gun press handle 2 is held and pressed to a first degree or position, the spray gun press handle 2 first pushes the switch central pin 51 to move in a first direction, illustratively backwards relative to the central pin guide sleeve 52. The inverted tapered post 513 of the switch central pin 51 moves away from the rear end face of the central pin guide sleeve 52, and the water inlet port of the central pin guide sleeve 52 is opened, whereupon the return spring 53 is in a compressed energy storing state. As indicated by the arrows in the figure, water flows upwardly along the spray gun lower inner core tube 3A and flows out from the front portion of the sink cavity 37 via the water outlet pipeline 3A4 into the first outlet waterway 34 and into the nozzle arrangement corresponding to the first outlet waterway 34.

Figure 12:
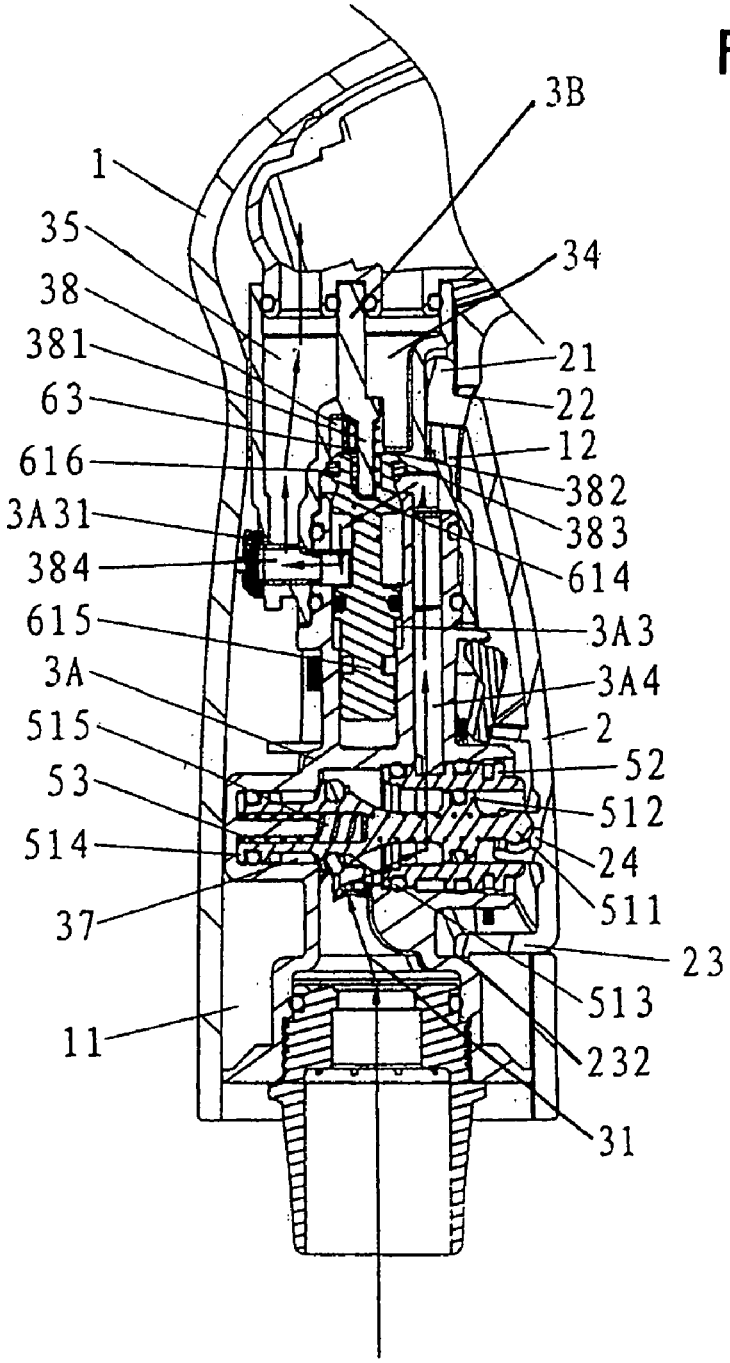
FIG. 12 is a sectional view showing entry of water in the second waterway of the faucet spray head of FIG. 9.

As shown in FIG. 12, when entry of water in the second waterway is controlled, the spray gun press handle 2 is further applied a force and held and pressed, the spray gun press handle 2 moves to a second degree or limiting position, the switch central pin 51 of the switch means 5 further moves backward in the first direction, and the waterway of the sink cavity 37 is still in an open state. But at this time, the inner wall surface of the spray gun press handle 2 can be pressed to the shift lever C. The shift lever C pushes the shift central pin 61 of the shift means 6 to move in a second direction perpendicular to the first direction, illustratively upwardly relative to the central pin guide sleeve 62. The tapered post 611 of the shift central pin 61 moves away from the accommodating seat 3A3 opening of the upper core tube 3B to open the water inlet port of the second outlet waterway 35. At the same time, the tapered post 611 encloses the water inlet port 382 of the sink cavity 38 and encloses the first inlet waterway 34, whereby the return spring 63 is in a compressed energy storing state. As indicated by the arrow in the figure, water flows upwardly along the spray gun lower inner core tube 3A, and flows out from the front portion of the sink cavity 37 and from the left-side water inlet port 383 of the sink cavity 38 into the accommodating seat 3A3 via the water outlet pipeline 3A4, and from the water inlet port 384 on the side wall thereof into the second outlet waterway 35, into the nozzle arrangement corresponding to the second outlet waterway 35.

Referring to FIG. 10, the spray gun press handle 2 is loosened, the spray gun press handle 2 is pressed back to the original activation state under the action of the return spring 53, 63 in the control means A and due to provision of the limiting face 22 on the spray gun press handle 2, whereupon the snap hook 232 at the inner side of the lower end face 23 of the spray gun press handle 2 exerts a limiting action thereto to prevent the spray gun press handle 2 from moving away from the spray gun body 1.

Although the invention has been described in detail with reference to certain preferred embodiments, variations and modifications exist within the spirit and scope of the invention as described and defined in the following claims.

The invention claimed is:

1. A faucet spray gun arrangement comprising a spray gun body, a spray gun press handle, a spray gun inner core tube and a control assembly, the spray gun press handle being pivotally supported by the spray gun body, the spray gun inner core tube being disposed in the spray gun body, and the control assembly engaging with the spray gun inner core tube and the spray gun press handle, wherein first and second outlet waterways are provided in the spray gun inner core tube, and the control assembly is provided with a movable central pin controlling and shifting between the first and second outlet waterways of the spray gun inner core tube respectively;

wherein the spray gun inner core tube includes a lower core tube and an upper core tube, a first water inlet port is provided at a lower portion of the lower core tube, and an accommodating seat and a water outlet pipeline are formed in an upper portion of the lower core tube, a second water inlet port is provided in a side wall of the accommodating seat, a sink cavity is formed in a middle portion of the lower core tube in a direction facing the spray gun press handle, an interior of the sink cavity is designed as a stepped configuration and a middle portion is communicating with the water outlet pipeline, a protruding post is formed at a bottom of the sink cavity, the upper core tube forms the first and second outlet waterways, a stepped sink cavity is formed in a longitudinal direction of the lower portion of the upper core tube, in the middle portion of the upper core tube at a left side of the stepped sink cavity are provided a third water inlet port communicating with the first outlet waterway and the second water inlet port, and in an upper portion of the upper core tube at a right side of the stepped sink cavity is provided a fourth water inlet port communicating with the second outlet waterway, and closely adjacent to the fourth water inlet port and on a right side wall of the stepped sink cavity is provided a fifth water inlet port communicating with the water outlet pipeline of the lower core tube;

wherein the control assembly includes a switch assembly and a shift assembly, the switch assembly cooperating with the inner core tube to control water flow through the first water inlet port of the lower core tube, and the shift assembly cooperating with the inner core tube to shift water flow between the first and second outlet waterways; and wherein the spray gun press handle is operably coupled to the switch assembly and the shift assembly such that pivoting movement of the spray gun press handle toward the spray gun body to a first degree moves only the switch assembly and further pivoting movement of the handle toward the spray gun body to a second degree greater than the first degree moves both the switch assembly and the shift assembly.

2. The faucet spray gun arrangement as claimed in claim 1, wherein a receiving chamber is provided in the spray gun body to receive the spray gun inner core tube, and the receiving chamber is connected at a lower end to a water inlet tube and at an upper end to an outlet nozzle, and an open area is provided in a front portion of the spray gun body to receive the spray gun press handle.

3. The faucet spray gun arrangement as claimed in claim 1, wherein the spray gun inner core tube is fixed in the spray gun body via an anti-release snap ring.

4. The faucet spray gun arrangement as claimed in claim 1, wherein the spray gun press handle is shaped in response to a position of an open area of the spray gun body and includes an upper end with a lug outside of which a limiting face is formed, and the lug is embedded in the upper end of the open area of the spray gun body.

5. The faucet spray gun arrangement as claimed in claim 4, wherein the spray gun press handle includes a lower end with an end face on which a recess is disposed.

6. The faucet spray gun arrangement as claimed in claim 4, wherein the spray gun press handle includes a lower end with an end face on which inner side a limiting snap hook is provided.

7. The faucet spray gun arrangement as claimed in claim 1, wherein a protruding post is formed on the upper portion of the sink cavity of the upper core tube.

8. The faucet spray gun arrangement as claimed in claim 1, wherein said control assembly is fixed on the spray gun inner core tube via a central pin snap ring.

9. A faucet spray gun arrangement comprising a spray gun body, a spray gun press handle, a spray gun inner core tube and a control assembly, the spray gun press handle being pivotally supported by the spray gun body, the spray gun inner core tube being disposed in the spray gun body, and the control assembly engaging with the spray gun inner core tube and the spray gun press handle, wherein first and second outlet waterways are provided in the spray gun inner core tube, and the control assembly is provided with a movable shift central pin controlling and shifting between the first and second outlet waterways of the spray gun inner core tube respectively;

wherein the control assembly comprises a switch assembly and a shift assembly, the spray gun inner core tube includes a lower core tube and an upper core tube, the switch assembly comprises a switch central pin, a central pin guide sleeve and a return spring, a post body is formed in a front portion of the switch central pin and mates with an inner cavity surface of a central pin guide sleeve, an inverted tapered post is formed in a middle portion of the switch central pin and has an outer diameter greater than an inner cavity diameter of the central pin guide sleeve and less than an inner diameter of a middle inner cavity of a sink cavity of the lower core tube, a cylindrical surface is formed at a rear portion of the switch central pin and mates with an inner wall surface of a bottom of the sink cavity of the lower core tube, a side wall of the central pin guide sleeve is provided with a water inlet port, the central pin guide sleeve is fixed at a front end of the sink cavity of the lower core tube, and the water inlet port is positioned in alignment with a water outlet pipeline opening in an upper portion of the sink cavity of the lower core tube, a rear end of the return spring is disposed around a protruding post on the bottom of the sink cavity of the lower core tube, or embedded in a groove on the bottom of the sink cavity of the lower core tube, and a front end of the return spring abuts in a counterbore or on a protruding post formed at a rear end of the switch central pin;

wherein the switch assembly cooperates with the inner core tube to control water flow through the first water inlet port of the lower core tube, and the shift assembly cooperates with the inner core tube to shift water flow between the first and second outlet waterways; and wherein the spray gun press handle is operably coupled to the switch assembly and the shift assembly such that pivoting movement of the spray gun press handle toward the spray gun body to a first degree moves only the switch assembly and further pivoting movement of the handle toward the spray gun body to a second degree greater than the first degree moves both the switch assembly and the shift assembly.

10. The faucet spray gun arrangement as claimed in claim 9, wherein an abutting head is disposed at a front end of the switch central pin, and an embedding groove is provided on an inner wall surface of the spray gun press handle corresponding to the abutting head.

11. A faucet spray gun arrangement comprising a spray gun body, a spray gun press handle, a spray gun inner core tube and a control assembly, the spray gun press handle being pivotally supported by the spray gun body, the spray gun inner core tube being disposed in the spray gun body, and the control assembly engaging with the spray gun inner core tube and the spray gun press handle, wherein first and second outlet waterways are provided in the spray gun inner core tube, and the control assembly is provided with a movable shift central pin controlling and shifting between the first and second outlet waterways of the spray gun inner core tube respectively;

wherein the control assembly comprises a switch assembly and a shift assembly, the spray gun inner core tube includes a lower core tube and an upper core tube, the shift assembly comprises the shift central pin and a return spring, a tapered post is formed in an upper portion of the shift central pin and has an outer diameter greater than an inner cavity diameter of an upper portion of a sink cavity of the upper core tube and an inner cavity diameter of an accommodating seat of the lower core tube, a cylindrical body is formed in a lower portion of the shift central pin and accommodated in the accommodating seat of the lower core tube, an upper end of the return spring is disposed around a protruding post in the upper portion of the sink cavity of the upper core tube or embedded in a groove in the upper portion of the sink cavity of the upper core tube, and a lower end of the return spring abuts in a counterbore or protruding post formed in the upper end of the shift central pin;

wherein the switch assembly cooperates with the inner core tube to control water flow through the first water inlet port of the lower core tube, and the shift assembly cooperates with the inner core tube to shift water flow between the first and second outlet waterways; and wherein the spray gun press handle is operably coupled to the switch assembly and the shift assembly such that pivoting movement of the spray gun press handle toward the spray gun body to a first degree moves only the switch assembly and further pivoting movement of the handle toward the spray gun body to a second degree greater than the first degree moves both the switch assembly and the shift assembly.

12. The faucet spray gun arrangement as claimed in claim 11, wherein one side of the lower portion of the shift central pin of the shift assembly engages with a lower portion of a shift lever, and a middle portion of the shift lever is embedded on a side wall of the lower core tube.

13. A faucet spray gun arrangement comprising:

a spray gun body;

a handle movably supported by the body;

an inner core tube positioned within the spray gun body and including an inlet and a pair of outlets;

a switch assembly operably coupled to the handle and cooperating with the inner core tube to control water flow through the inlet of the inner core tube; and a shift assembly operably coupled to the handle and positioned in spaced relation to the switch assembly, the shift assembly cooperating with the inner core tube to shift water flow between the pair of outlets, wherein in a normal position the switch assembly prevents water flow through the inlet to the shift assembly, movement of the handle to a first position in a direction toward the body causes the switch assembly to permit water flow through the inlet to the shift assembly and the shift assembly to provide fluid communication between the water inlet port and a first one of the two outlet waterways, and movement of the handle to a second position in a direction toward the body from the first position causes the switch assembly to permit water flow through the inlet to the shift assembly and the shift assembly to provide fluid communication between the water inlet port and a second one of the two outlet waterways.

14. The faucet spray gun arrangement of claim 13, wherein the shift assembly includes a movable central pin controlling and shifting the pair of outlets of the inner core tube.

15. The faucet spray gun arrangement of claim 13, wherein the shift assembly is disposed substantially perpendicular to the switch assembly.

16. The faucet spray gun arrangement of claim 13, wherein the handle is pivotally supported by a front portion of the spray gun body and configured to be pressed by the fingers of a user holding the spray gun body.

17. A faucet spray gun arrangement comprising:

a spray gun body;

a handle movably supported by the body;

an inner core tube positioned within the spray gun body and including an inlet and a pair of outlets;

a switch assembly operably coupled to the handle and cooperating with the inner core tube to control water flow through the inlet of the inner core tube;

a shift assembly operably coupled to the handle and positioned in spaced relation to the switch assembly, the shift assembly cooperating with the inner core tube to shift water flow between the pair of outlets, wherein movement of the handle to a first position in a direction toward the body causes the switch assembly and the shift assembly to provide fluid communication between the water inlet port and a first one of the two outlet waterways, and movement of the handle to a second position in a direction toward the body from the first position causes the switch assembly and the shift assembly to provide fluid communication between the water inlet port and a second one of the two outlet waterways; and wherein the handle is operably coupled to the switch assembly and the shift assembly such that movement of the handle to a first degree moves only the switch assembly and movement of the handle to a second degree moves both the switch assembly and the shift assembly.

18. A faucet spray gun arrangement comprising:

a spray gun body;

a handle movably supported by the body;

an inner core tube positioned within the spray gun body and including an inlet and a pair of outlets;

a switch assembly operably coupled to the handle and cooperating with the inner core tube to control water flow through the inlet of the inner core tube;

a shift assembly operably coupled to the handle and positioned in spaced relation to the switch assembly, the shift assembly cooperating with the inner core tube to shift water flow between the pair of outlets, wherein movement of the handle to a first position in a direction toward the body causes the switch assembly and the shift assembly to provide fluid communication between the water inlet port and a first one of the two outlet waterways, and movement of the handle to a second position in a direction toward the body from the first position causes the switch assembly and the shift assembly to provide fluid communication between the water inlet port and a second one of the two outlet waterways; and wherein the shift assembly includes a movable central pin controlling and shifting the pivot of outlets of the inner core tube, and the switch assembly includes a central pin movable in a direction perpendicular to the central pin of the shift assembly and controlling water flow through the inlet of the inner core tube.

19. A faucet spray gun arrangement comprising:

a spray gun body;

a handle pivotally supported by the body;

a switch assembly operably coupled to the handle for movement in a first direction to activate water flow through an inlet in response to pivoting of the handle toward the spray gun body to a predetermined angular position; and a shift assembly operably coupled to the handle for movement in a second direction at an angle relative to the first direction to shift water flow between a plurality of different outlets in response to further pivoting of the handle in the same direction toward the spray gun body beyond the predetermined angular position;

wherein the handle is operably coupled to the switch assembly and the shift assembly such that movement of the handle to a first degree moves only the switch assembly and movement of the handle to a second degree moves both the switch assembly and the shift assembly.

20. A faucet spray gun arrangement comprising:

a spray gun body;

a handle pivotally supported by the body;

a switch assembly operably coupled to the handle for movement in a first direction to activate water flow through an inlet in response to pivoting of the handle toward the spray gun body to a predetermined angular position; and a shift assembly operably coupled to the handle for movement in a second direction at an angle relative to the first direction to shift water flow between a plurality of different outlets in response to further pivoting of the handle in the same direction toward the spray gun body beyond the predetermined angular position;

wherein the shift assembly is disposed substantially perpendicular to the switch assembly.

* * * * *